US007188835B2

(12) United States Patent
Lee et al.

(10) Patent No.: US 7,188,835 B2
(45) Date of Patent: Mar. 13, 2007

(54) SHEET FEEDING APPARATUS FOR IMAGE FORMING DEVICE

(75) Inventors: Jin-soo Lee, Suwon (KR); Min-seon Kim, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 194 days.

(21) Appl. No.: 10/449,397

(22) Filed: Jun. 2, 2003

(65) Prior Publication Data

US 2004/0036207 A1 Feb. 26, 2004

(30) Foreign Application Priority Data

Aug. 21, 2002 (KR) ..... 2002-49567

(51) Int. Cl.
*B65H 1/08* (2006.01)

(52) U.S. Cl. ..... 271/147; 271/157; 271/162

(58) Field of Classification Search ..... 271/145, 271/147, 157, 160, 162, 164; 221/227; 399/377
See application file for complete search history.

(56) References Cited

U.S. PATENT DOCUMENTS

| | | | | |
|---|---|---|---|---|
| 3,563,535 | A * | 2/1971 | Vitu et al. | 271/157 |
| 6,149,147 | A * | 11/2000 | Hur et al. | 271/160 |
| 6,173,951 | B1 * | 1/2001 | Inoue et al. | 271/121 |

FOREIGN PATENT DOCUMENTS

| | | | |
|---|---|---|---|
| JP | 57-4835 | * | 1/1982 |
| JP | 61-127531 | * | 6/1986 |
| JP | 3-36124 | * | 2/1991 |
| JP | 3-256932 | * | 11/1991 |
| JP | 6-72570 | * | 3/1994 |

OTHER PUBLICATIONS

English translation of the numbered paragraph 2 on page 1 of Japanese Publication No. 3-256932.*

* cited by examiner

*Primary Examiner*—Patrick Mackey
*Assistant Examiner*—Thomas Morrison
(74) *Attorney, Agent, or Firm*—Staas & Halsey LLP

(57) ABSTRACT

A sheet feeding apparatus for an image forming device prevents a sheet jammed in a pickup roller from being damaged when a sheet feeding cassette is separated to remove the jammed sheet. The sheet feeding apparatus for the image forming device includes a sheet feeding cassette being removably installed in the image forming device and having a handle hole for adhesion and removal, a sheet pressure plate hinge-fixed in the sheet feeding cassette, to load and support sheets, an elastic member to elastically support the sheet pressure plate to be upwardly slanted, and a down lever installed at the lower portion of the sheet pressure plate to be moved forward or backward. When the down lever is pulled through the handle hole, the sheet pressure plate is downwardly rotated to compress the elastic member, and when the down lever is pushed, the sheet pressure plate returns to the original position by the elastic member.

20 Claims, 4 Drawing Sheets

SHEET FEEDING APPARATUS FOR IMAGE FORMING DEVICE

CROSS-REFERENCE TO RELATED APPLICATIONS

This application claims the benefit of Korean Application No. 2002-49567, filed Aug. 21, 2002, in the Korean Intellectual Property Office, the disclosure of which is incorporated herein by reference.

BACKGROUND OF THE INVENTION

1. Field of the Invention

The present invention relates to a sheet feeding apparatus for an image forming device, and more particularly to a sheet feeding apparatus which includes a sheet feeding cassette removably connected to an image forming device main body and a pickup roller to pick up a sheet.

2. Description of the Related Art

An image forming device transfers a print medium such as paper or a thin plastic plate (hereinafter, referred to as a 'sheet') and prints images or characters on the transferred sheet. Exemplary image forming devices include a printer and a copier. A general image forming device has a sheet feeding apparatus to continuously feed sheets to an image forming device main body for consecutive printing.

In order to serve the aforementioned purpose, a variety of sheet feeding apparatuses have been suggested for the image forming device. In general, a sheet feeding apparatus including a sheet feeding cassette and a pickup roller have been used.

The general sheet feeding apparatus has the sheet feeding cassette removably installed in the image forming device main body, and the pickup roller installed in the image forming device main body is positioned above the sheet feeding cassette mounted on the image forming device main body.

Referring to FIG. 1, the sheet feeding cassette 10 includes a cassette frame 12, a sheet pressure plate 16 and a compression coil spring 18. The cassette frame 12 guides the sheet feeding cassette 10 to be mounted in or removed from the image forming device main body. A handle hole 15 is formed on the front surface 14 of the cassette frame 12 for mounting or removing the sheet feeding cassette 10.

The sheet pressure plate 16 is positioned on the cassette frame 12, and has one end hinge-connected to a support bracket 13 protruded from the bottom of the cassette frame 12. The other end of the sheet pressure plate 16 is elastically supported by the compression coil spring 18. Accordingly, the sheet pressure plate 16 is upwardly slanted to the bottom surface of the cassette frame 12.

The operation of the above-described sheet feeding apparatus will now be explained.

The sheets are loaded on the sheet pressure plate 16. The user pushes the sheet feeding cassette 10 into the image forming device main body by holding the handle hole 15 of the front surface 14 of the cassette frame 12. When the sheet feeding cassette 10 is mounted on the image forming device main body, the top sheet loaded on the sheet pressure plate 16 contacts the pickup roller. Here, the sheet pressure plate 16 is elastically supported upward by the compression coil spring 18, and thus pressure is applied to the top sheet by the pickup roller. Accordingly, when the pickup roller is rotated, the top sheet is transferred to the image forming device main body due to a frictional force between the pickup roller and the sheet.

However, the sheet feeding apparatus using the sheet feeding cassette has a disadvantage in that the sheet can be jammed between the sheet feeding cassette and the pickup roller depending on the type of sheet or due to abrasion of the pickup roller. When the sheet is jammed, the sheets loaded on the sheet feeding cassette 10 cannot be fed. It is thus necessary to remove the jammed sheet. In this case, the sheet feeding cassette 10 must be separated from the image forming device main body to pull the jammed sheet out of the pickup roller.

In the sheet feeding apparatus using the sheet feeding cassette 10, the sheet feeding cassette 10 is separated so as to remove the jammed sheet. However, since the sheet pressure plate 16 pressures the sheet against the pickup roller, the jammed sheet is damaged due to a force of pulling the sheet feeding cassette 10. That is, when the sheet feeding cassette 10 is separated in order to remove the jammed sheet, the non-used sheet is torn, which increases consumption of sheets and reduces reliability of the image forming device.

SUMMARY OF THE INVENTION

Accordingly, it is an aspect of the present invention to solve at least the above problems and/or disadvantages and to provide at least the advantages described hereinafter.

Additional aspects and advantages of the invention will be set forth in part in the description which follows and, in part, will be obvious from the description, or may be learned by practice of the invention.

The foregoing and/or other aspects may be achieved by providing a sheet feeding apparatus for an image forming device which can prevent a sheet jammed in a pickup roller from being damaged, when a sheet feeding cassette is separated to remove the jammed sheet.

The foregoing and/or other aspects and advantages may be realized by providing a sheet feeding apparatus for an image forming device comprising a sheet pressure plate to load and support sheets; an elastic member to elastically support an end of the sheet pressure plate; and a down lever installed under the sheet pressure plate to move forward or backward, wherein, the sheet pressure plate is downwardly rotated when the down lever is pulled. A down loop to interfere with the down lever may be formed on the bottom surface of the sheet pressure plate. In addition, a handle may be formed at one end of the down lever and a slant surface hooked over the down loop may be formed at the other end thereof. The sheet feeding apparatus may further include a return unit for returning the pulled down lever to the original position.

The foregoing and/or other aspects may also be achieved by providing a sheet feeding apparatus for an image forming device including a main body; a sheet feeding cassette removably installed in the main body and having a handle hole to mount and remove the sheet feeding cassette into/from the main body; a sheet pressure plate; a hinge to fix the sheet pressure plate in the sheet feeding cassette, to load and support sheets; an elastic member elastically support the sheet pressure plate to be slanted; and a down lever installed under the sheet pressure plate to be moved forward or backward, wherein, when the down lever is pulled through the handle hole, the sheet pressure plate is downwardly rotated.

A down loop to interfere with the down lever may be formed on the bottom surface of the sheet pressure plate. In addition, a handle which the user can grip through the handle hole is formed at one end of the down lever, and a slant surface hooked over the down loop is formed at the other end thereof. The sheet feeding apparatus may further include a return unit installed between the sheet feeding cassette and the down lever handle, to return the pulled down lever to the original position.

When the sheet feeding cassette is separated so as to remove the sheet jammed in the pickup roller, the jammed sheet is not damaged. Accordingly, the sheet feeding apparatus for the image forming device reduces consumption of sheets and increases reliability on the image forming device itself.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
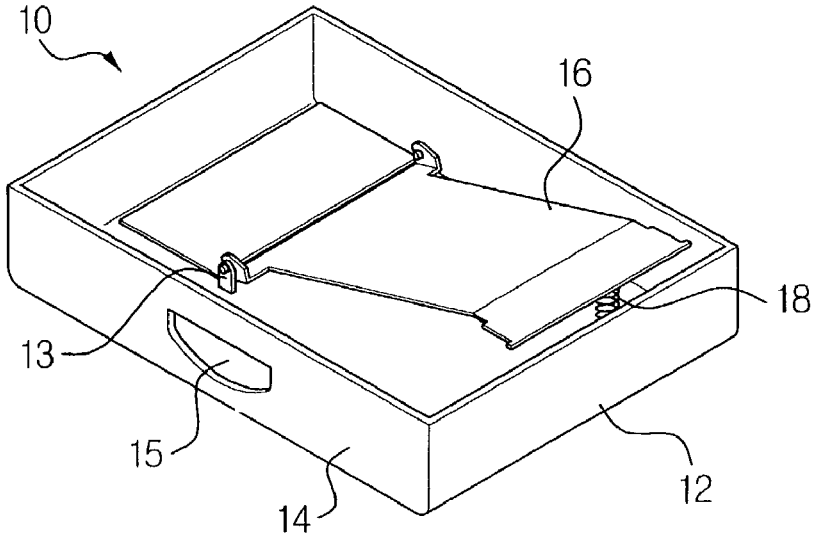
FIG. 1 (PRIOR ART)
FIG. 1 is a perspective view illustrating a conventional sheet feeding cassette for an image forming device.

Reference will now be made in detail to the present preferred embodiments of the present invention, examples of which are illustrated in the accompanying drawings, wherein like reference numerals refer to like elements throughout.

Figure 2:
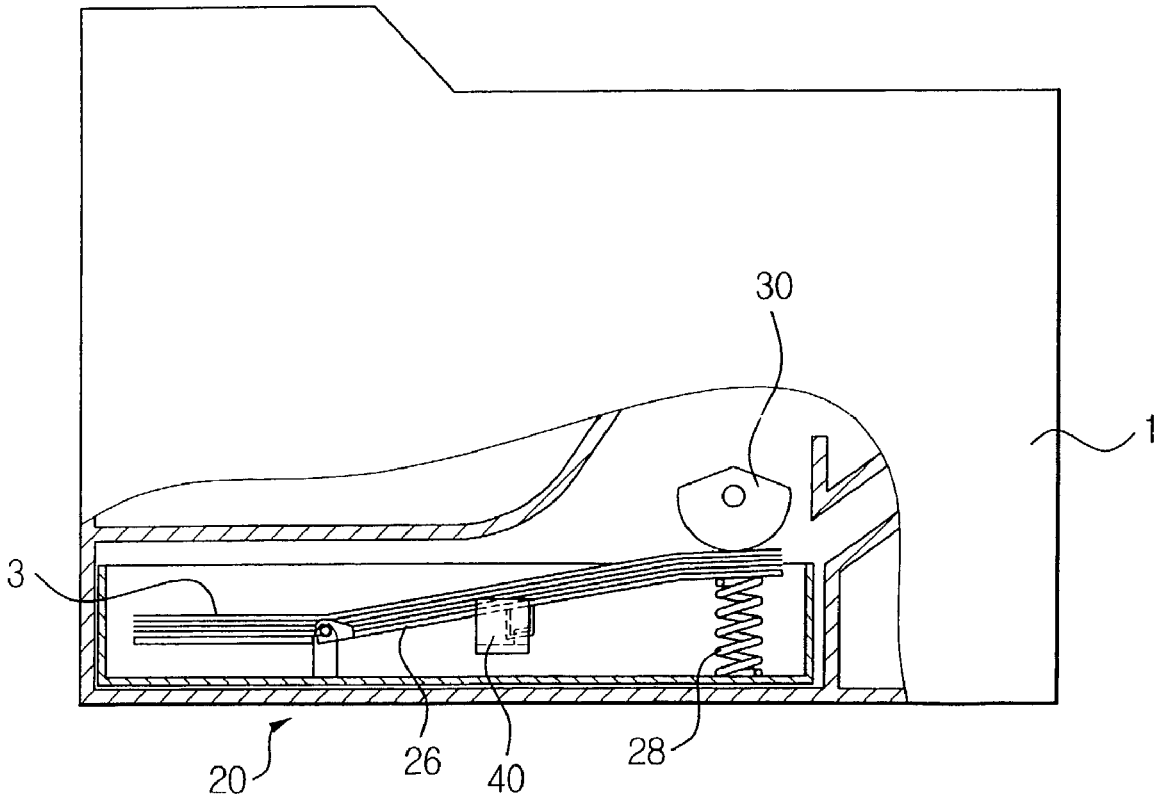
FIG. 2 is a partial cross-sectional view illustrating a sheet feeding apparatus mounted on an image forming device in accordance with an embodiment of the present invention.

Referring to FIG. 2, a sheet feeding apparatus for an image forming device according to an embodiment of the present invention includes a sheet feeding cassette 20 and a pickup roller 30.

Figure 3:
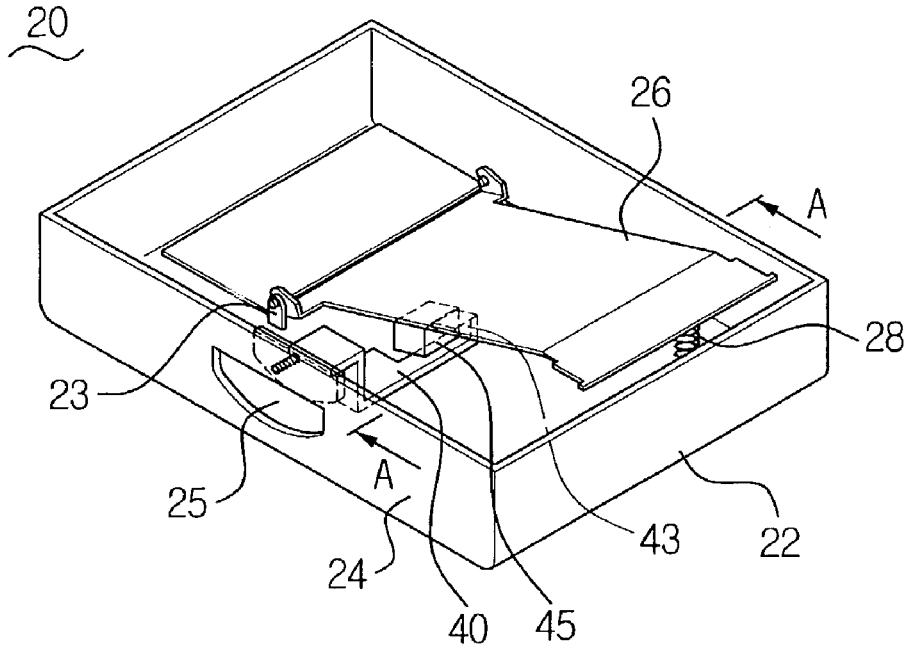
FIG. 3 is a perspective view illustrating a sheet feeding cassette of FIG. 2.
Figure 4:
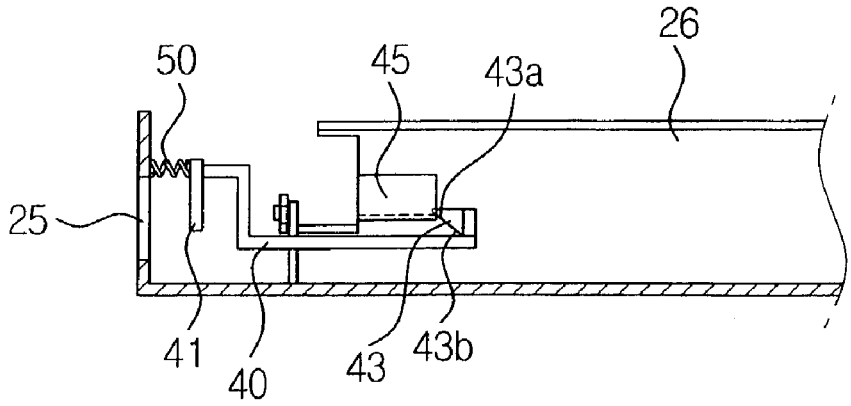
FIG. 4 is a cross-sectional view illustrating the sheet feeding cassette of FIG. 3, taken along line A—A.
Figure 5:
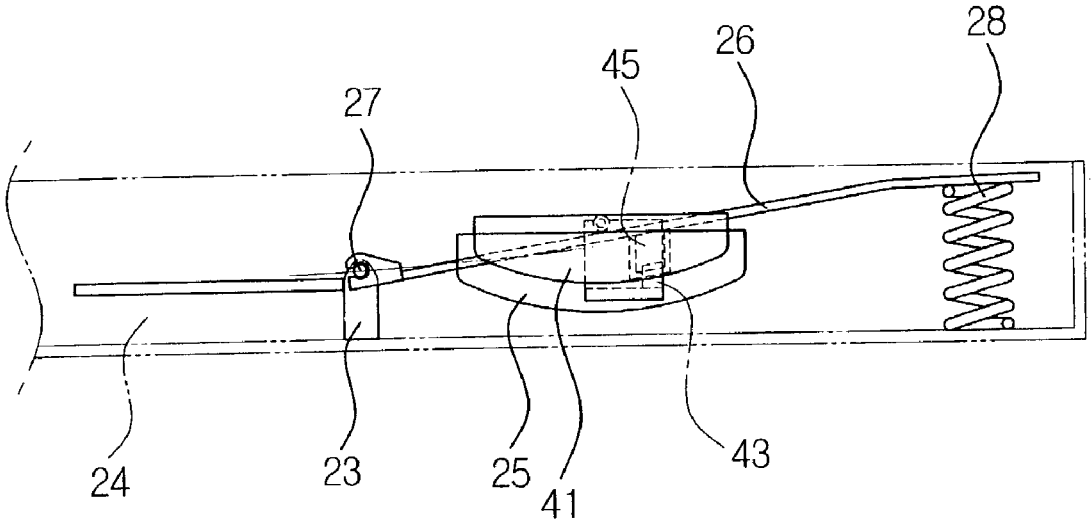
FIG. 5 is a front view illustrating the sheet feeding cassette of FIG. 3.
Figure 6:
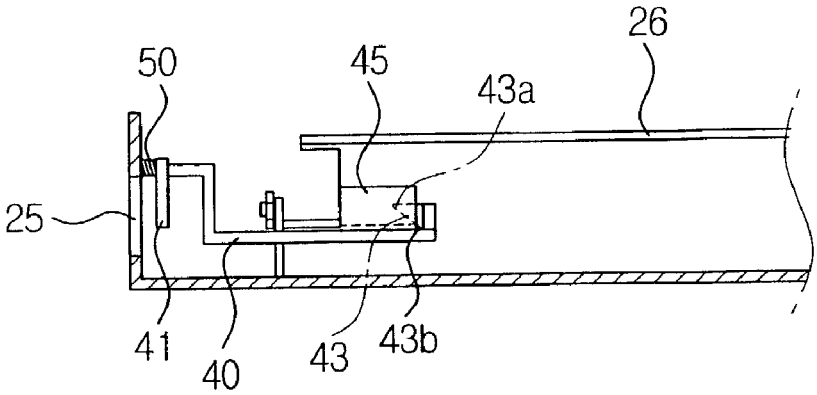
FIG. 6 is a cross-sectional view showing a state in which a down lever is operated in the sheet feeding cassette of FIG. 3, taken along line A—A.
Figure 7:
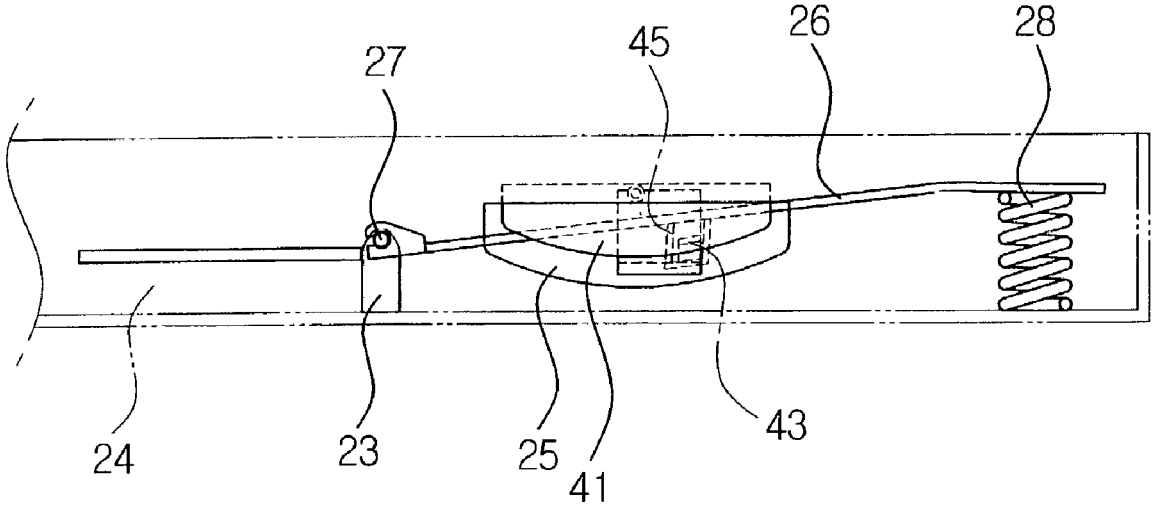
FIG. 7 is a front view showing a state in which the down lever is operated in the sheet feeding cassette of FIG. 3.

As shown in FIGS. 3 to 5, the sheet feeding cassette 20 has a cassette frame 22, a sheet pressure plate 26, an elastic member 28 and a down lever 40.

The cassette frame 22 is the external portion of the sheet feeding cassette 20, and enables the sheet feeding cassette 20 to be mounted in or removed from an image forming device main body 1. (See FIG. 2) A cassette cover 24 is installed on the front surface of the cassette frame 22. A handle hole 25, which the user can grip to mount or remove the sheet feeding cassette 20 in/from the image forming device main body 1 is formed in the cassette cover 24.

The sheet pressure plate 26 to load and support sheets 3 is installed in the cassette frame 22. One end of the sheet pressure plate 26 is hinge-fixed to a support bracket 23 protruding from the bottom of the cassette frame 22, and the other end thereof is elastically supported by the elastic member 28. Accordingly, the other end of the sheet pressure plate 26 is upwardly rotated on a hinge 27 by the elastic member 28, and thus the sheet pressure plate 26 is upwardly slanted to the bottom of the cassette frame 22. In addition, a down loop 45 hooked over the down lever 40 is installed on the bottom surface of the sheet pressure plate 26.

The elastic member 28 elastically biases the sheet pressure plate 26 upward, thereby generating frictional force between the pickup roller 30 and the sheets 3 loaded on the sheet pressure plate 26. Therefore, the elastic member 28 should have elasticity to generate sufficient frictional force to separately transfer the sheets 3. Any type of elastic member may be used, for example, a compression coil spring.

The down lever 40 is positioned between the sheet pressure plate 26 and the bottom of the cassette frame 22 to be moved forward or backward to/from the handle hole 25 of the cassette cover 24. A handle 41 is formed at one end of the down lever 40 to be pulled by the user through the handle hole 25 of the cassette cover 24, and a slant surface 43 on a wedge is formed at the other end of the down lever 40. A slant of the slant surface 43 corresponds to the down loop 45 installed on the bottom surface of the sheet pressure plate 26. That is, when the sheet pressure plate 26 is upwardly slanted, the upper portion 43*a* of the slant surface 43 is hooked over the down loop 45, and when the sheet pressure plate 26 maintains the horizontal state, the lower portion 43*b* of the slant surface 43 is hooked over the down loop 45. The down lever 40 is linearly reciprocated in the vertical direction, perpendicular with respect to the sheet transfer direction. However, it should be recognized that the down lever 40 can be linearly reciprocated in the same direction as the sheet transfer direction.

In addition, the down lever 40 may further include a return unit 50 to operate the down lever 40 so that the down loop 45 hooked over the lower portion 43*b* of the slant surface 43 can be automatically hooked over the upper portion 43*a* of the slant surface 43. An elastic member, for example, a coil spring, having sufficient elasticity to operate the down lever 40 can be used as the return unit 50. A compression coil spring positioned between the cassette cover 24 and the handle 41 of the down lever 40 is used as the return unit 50. Accordingly, when the user pulls the handle 41 of the down lever 40, the down lever 40 is moved toward the cassette cover 24. When the user releases the handle 41, the down lever 40 automatically returns to the original position by the return unit 50. Therefore, the sheet pressure plate 26 which maintains the horizontal state automatically returns to the slant state. The pickup roller 30 is positioned at the upper portion of the sheet pressure plate 26 to be rotated on the image forming device main body 1.

The operation of the sheet feeding apparatus for the image forming device will now be described in more detail with reference to FIGS. 2 to 7.

When the sheet is jammed between the sheet feeding cassette 20 and the pickup roller 30, the user separates the sheet feeding cassette 20 from the image forming device main body 1 to remove the jammed sheet. Here, when the user pulls the handle 41 of the down lever 40 through the handle hole 25 of the cassette cover 24, the return unit 50 is compressed to pull the down lever 40 forward. Therefore, the slant surface 43 of the down lever 40 is moved forward, and thus the down loop 45 hooked over the upper portion 43*a* of the slant surface 43 is moved downward along the slant surface 43 and hooked over the lower portion 43*b* of the slant surface 43. When the down loop 45 is moved downward, the elastic member 28 is compressed to maintain the sheet pressure plate 26 in the horizontal state (refer to FIGS. 6 and 7).

When the sheet pressure plate 26 maintains the horizontal state, a space is formed between the sheet 3 and the pickup roller 30. When the space is formed between the sheet 3 and the pickup roller 30, if the user separates the sheet feeding cassette 20, the sheet jammed in the pickup roller 30 does not receive a force of pulling of the sheet feeding cassette 20. Accordingly, the user can separate the sheet feeding cassette 20 without damaging the jammed sheet. Thereafter, the sheet jammed in the pickup roller 30 can be removed.

When the user separates the sheet feeding cassette 20 and releases the down lever 40, the down lever 40 returns to the original position by the return unit 50. Accordingly, the sheet pressure plate 26 which maintains the horizontal state by the down loop 45 hooked over the lower portion 43*b* of the slant surface 43 of the down lever 40 is upwardly rotated due to recovery force of the elastic member 28. When the sheet pressure plate 26 maintains the upward slant state, the down loop 45 is positioned at the upper portion 43*a* of the slant surface 43 of the down lever 40.

When the user mounts the sheet feeding cassette 20 on the image forming device main body 1 after removing the jammed sheet, the user pulls the handle 41 of the down lever 40. As described above, the sheet pressure plate 26 maintains the horizontal state by the down lever 40 and the down loop 45, and thus the user can easily mount the sheet feeding cassette 20 on the image forming device main body 1.

As discussed earlier, in accordance with the present invention, the sheet feeding cassette can be separated in a state in which the space is formed between the pickup roller and the sheet loaded on the sheet feeding cassette. As a result, when the sheet feeding cassette is separated, the sheet jammed in the pickup roller is not damaged.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A sheet feeding apparatus for an image forming device, comprising:

a sheet pressure plate to load and support sheets;

an elastic member to elastically support an end of the sheet pressure plate;

a down loop formed on a portion of a bottom surface of the sheet pressure plate;

a down lever installed under the sheet pressure plate said down lever having a wedge to hook over the down loop and to linearly move forward or backward without rotating;

wherein the sheet pressure plate is downwardly rotated when the down lever is pulled.

2. A sheet feeding apparatus for an image forming device, comprising:

a sheet pressure plate to load and support sheets;

an elastic member to elastically support an end of the sheet pressure plate;

a down lever installed under the sheet pressure plate to move forward or backward said down lever having a wedge;

a down loop formed on a bottom surface of the sheet pressure plate to be hooked by the wedge of the down lever;

a handle formed at a first end of the down lever; and a slanting surface hooked over the down loop formed at a second end of the down lever, wherein the sheet pressure plate is downwardly rotated when the down lever is puller.

3. The apparatus according to claim 1, further comprising a return unit to return the pulled down lever to an original position.

4. The apparatus according to claim 3, wherein the return unit is a compression coil spring.

5. A sheet feeding apparatus for an image forming device, comprising:

a main body;

a sheet feeding cassette removably installed in the main body and having a handle hole to allow a user to mount and remove the sheet feeding cassette into or from the main body;

a sheet pressure plate;

a hinge to fix the sheet pressure plate in the sheet feeding cassette, to load and support sheets;

an elastic member elastically supporting the sheet pressure plate to be slanted;

a down loop formed on a bottom surface of the sheet pressure plate; and a down lever installed under the sheet pressure plate to be moved forward or backward parallel to the hinge, wherein, the down lever being hooked over the down loop so that when the down lever is pulled, the sheet pressure plate is downwardly rotated.

6. The apparatus according to claim 5, wherein the down lever comprises a handle to be held by a user by reaching through the handle hole and being formed at a first end of the down lever, and a slanting surface, formed at a second end of the down lever and hooked over the down loop formed at the other end thereof, wherein the down loop is moved downward by the slanting surface when the down lever is pulled to thereby downwardly rotate the sheet pressure plate.

7. The apparatus according to claim 6, further comprising a return unit installed between the sheet feeding cassette and the handle, to return the pulled down lever to an original position.

8. The apparatus according to claim 7, wherein the return unit is a compression coil spring.

9. An image forming device, comprising:

a main body;

a sheet feeding cassette removably installed in the main body and having a handle hole to allow a user to mount and remove the sheet feeding cassette into or from the main body;

a sheet pressure plate;

a hinge to fix the sheet pressure plate in the sheet feeding cassette, to load and support sheets;

a pickup roller installed opposite the sheet pressure plate, to feed the loaded sheets one by one;

an elastic member to elastically support an end of the sheet pressure plate in a direction in which the loaded sheets contact the pickup roller;

a down loop formed on a bottom surface of the sheet pressure plate; and a down lever installed under the sheet pressure plate to be moved forward or backward parallel to the hinge, wherein, the down lever is hooked over the down loop so that when the down lever is pulled, the sheet pressure plate is downwardly rotated via the down loop to separate the currently fed sheet from the pickup roller and to separate the cassette from the main body.

10. An image forming device, comprising:

a main body;

a sheet feeding cassette removably installed in the main body and having a handle hole to allow a user to mount and remove the sheet feeding cassette into or from the main body;

a sheet pressure plate;

a hinge to fix the sheet pressure plate in the sheet feeding cassette, to load and support sheets;

a pickup roller installed opposite the sheet pressure plate, to feed the loaded sheets one by one;

an elastic member to elastically support an end of the sheet pressure plate in a direction in which the loaded sheets contact the pickup roller;

a down lever installed under the sheet pressure plate to be moved forward or backward parallel to the hinge, wherein, when the down lever is pulled, the sheet pressure plate is downwardly rotated to separate the currently fed sheet from the pickup roller and to separate the cassette from the main body;

a down loop to hook over the down lever and formed on a bottom surface of the sheet pressure plate; and a handle to be held by a user by reaching through the handle hole, and being formed at a first end of the down lever, and a slanting surface, formed at a second end of the down lever and hooked over the down loop.

11. The device according to claim 10, further comprising a compression coil spring installed between the sheet feeding cassette and the handle, to return the pulled down lever to an original position.

12. An apparatus comprising:

a plate to load sheets thereon;

a roller to pick up the loaded sheets;

a loop on an underside of the plate; and a lever under the plate, said lever having a wedge hooked over the loop and to move forward or backward to thereby move the plate towards and away from the roller by moving over the loop, the plate being rotated away from the roller about an axis parallel to the movement of the lever when separating the plate from the roller.

13. The apparatus according to claim 12, further comprising an elastic member to bias the plate towards the roller in a state of normal operation of the apparatus.

14. The apparatus according to claim 13, wherein a force applied to the lever by a user overcomes the bias of the elastic member when separating the plate from the roller.

15. The apparatus according to claim 13, further comprising a frame to house the plate, the plate being substantially horizontal in the separated state to form a space between the roller and the plate.

16. The apparatus according to claim 12, wherein the lever linearly reciprocates in a direction perpendicular to a direction of transferring the loaded sheets.

17. An apparatus comprising:

a plate to load sheets thereon;

a loop extending from the plate;

a roller to pick up the loaded sheets; and a unit to hook over the loop and reciprocate linearly in a direction perpendicular to a direction of transferring the loaded sheets and parallel to a rotation axis of the plate to separate the plate from the roller in the event one of the sheets is jammed in the roller, so that the jammed sheet does not receive a force from the plate, the unit comprising a surface slanted with respect to the direction of transferring the loaded sheets and the direction of linear reciprocation of the unit, the loop moving over the slanting surface during the linear reciprocation.

18. The apparatus according to claim 17, wherein the unit moves the plate to form a space between the sheet and the roller.

19. A sheet feeding apparatus for an image forming device, comprising:

a main body;

a sheet feeding cassette removably installed in the main body and having a handle hole to allow a user to mount and remove the sheet feeding cassette into or from the main body;

a sheet pressure plate:

a hinge to fix the sheet pressure plate in the sheet feeding cassette, to load and support sheets;

an elastic member to elastically support the sheet pressure plate to be slanted; and a down lever installed under the sheet pressure plate to be moved forward or backward parallel to the hinge, wherein, when the down lever is pulled, the sheet pressure plate is downwardly rotated, wherein the elastic member is fixed to the sheet feeding cassette.

20. The apparatus according to claim 1, wherein the sheet pressure plate is downwardly rotated when the down lever is pulled horizontally.

* * * * *

UNITED STATES PATENT AND TRADEMARK OFFICE

CERTIFICATE OF CORRECTION

PATENT NO. : 7,188,835 B2
APPLICATION NO. : 10/449397
DATED : March 13, 2007
INVENTOR(S) : Jin-soo Lee et al.

It is certified that error appears in the above-identified patent and that said Letters Patent is hereby corrected as shown below:

Column 5, Line 47, after “plate” insert --,--.

Column 5, Line 60, after “backward” insert --,--.

Column 5, Line 66, after “surface” insert --of the wedge being--.

Column 6, Line 2, delete “puller.” to --pulled.--.

Column 8, Line 32, change “plate:” to --plate;--.

Signed and Sealed this

Twenty-sixth Day of June, 2007

JON W. DUDAS
*Director of the United States Patent and Trademark Office*